US005630535A

United States Patent [19]

Valenti

[11] Patent Number: 5,630,535

[45] Date of Patent: May 20, 1997

[54] CLIP FOR HANDGUN SUPPORT

[76] Inventor: Paul J. Valenti, 7311 Coal Creek Pkwy. #B104, Newcastle, Wash. 98059-3170

[21] Appl. No.: 453,973

[22] Filed: May 30, 1995

[51] Int. Cl.[6] ..... A45F 5/00

[52] U.S. Cl. ..... 224/271; 224/191; 224/192; 224/269; 224/666; 224/667; 24/563; 24/3.11

[58] Field of Search ..... 224/271, 163, 224/192, 194, 198, 238, 269, 666, 667; 24/3.11, 3.12, 529, 530, 532, 537, 542, 545, 588, 458, 563; 89/196, 125, 162, 161; 248/682, 684, 231.81

[56] References Cited

U.S. PATENT DOCUMENTS

| | | | |
|---|---|---|---|
| 2,320,450 | 6/1943 | Valenzuela | 24/259 |
| 3,300,109 | 1/1967 | Clark | 224/667 |
| 4,056,218 | 11/1977 | Barna | 224/255 |
| 4,121,743 | 10/1978 | Burton | 224/916 |
| 4,256,245 | 3/1981 | Serres | 224/273 |
| 4,667,374 | 5/1987 | Bianchi | 224/667 |
| 4,705,086 | 11/1987 | O'Neill | 224/666 |

*Primary Examiner*—Renee S. Luebke
*Assistant Examiner*—Kam R. Shah
*Attorney, Agent, or Firm*—Keith S. Bergman

[57] ABSTRACT

A semi-rigid, elastically resilient clip is releasably fastenable to the side of a handgun to provide support for the handgun upon a user's clothing or on a mounting bracket on a support structure. The clip may be attached by bolting to a handgun or, in the case of automatic weapons having a barrel slide movable relative to a gun body, it may be attached by engagement of a clip bracket between the gun body and barrel slide portions.

2 Claims, 2 Drawing Sheets

CLIP FOR HANDGUN SUPPORT

BACKGROUND OF INVENTION

1. Related Applications

There are no applications related hereto heretofore filed in this or any foreign country.

2. Field of Invention

This invention relates generally to support devices for handguns, and more particularly to a clip releasably fastened to a handgun to provide support on a user's clothing or in a bracket attached to a supportalive structure.

3. Background and Description of Prior Art

Handguns generally are relatively small articles that often for use, especially for self-protection or combat, must continuously be readily available to a user. Handguns also have various externally protruding parts which essentially effect their operation, such as sights, trigger guards, safeties, magazine releases, and the like which may be accidentally or unintentionally moved during storage. Since handguns often are carried in a fully loaded condition for rapid emergency use, the accidental change of their operating elements may create severe problems and make the guns dangerous both to a user and third parties. These problems have heretofore been recognized and responsively various holding and support devices for handguns have become known. The instant invention presents a new and novel member of this group of devices.

Many holding devices have taken the form of a holster of some type that contains a portion or substantially all of a handgun to positionally maintain it by gravity, friction fastening straps, or a combination of these means. Commonly such holsters are supported somewhere on the body of a user, especially at or about the waist or in the vicinity of a shoulder, though they may be supported at almost any position on a body, in clothing or on various support structures. Many holsters effectively positionally maintain a handgun, though none has been found to be completely ideal for such purpose and each of the various types of holsters present various unsolved problems. Most holsters are formed of a semi-rigid, somewhat resilient material, commonly some type of harder leather, and commonly such material is shaped somewhat to the configuration of a handgun that is to be carried in it, with an opening through which the handgun may be inserted into and withdrawn from the holster.

Such holsters, to provide any particular security for holding of a handgun, generally encase a substantial portion of the gun to be held and if so, commonly when the handgun is moved into and out of such a holster, various portions of the gun surface have moving frictional engagement with the inner surface of the holding holster. Over a period of time this causes wear on the handgun surface and since many handguns have a colored or so-called "blued" surface, this coloration may be removed to show distinct evidence of wear on the handgun surface. This showing of wear is not aesthetically desirable and might even cause mechanical problems.

Holsters that support a handgun over a relatively small portion of its surface generally must do so with substantially more force than holsters that support a handgun over a larger portion of the surface and such holsters therefore generally have substantially more frictional engagement with a portion of the handgun they support. This enhances the wear problem as the increased friction causes greater and more rapid wear and the wear is more concentrated in a particular location so that it may be more pronounced to visual inspection. The instant holding device provides a clip carried on the handgun surface for fastening to some second object to do away with the holster entirely and alleviate the wear problems associated therewith.

Often it is relatively difficult to insert and withdraw a handgun from the traditional containment type holster and in so doing, it may be difficult to grip the handgun and, when it is gripped, the gripping may be in some fashion other than that in which the gun commonly would be held for shooting. Generally the more securely the handgun is held and maintained in a holster, the more difficult and clumsy it is of insertion and withdrawal. In combat and self-defensive situations, this problem becomes quite critical and may present substantial dangers to a user, even though the user is habitually familiar with the method and manner of use of a particular holster and handgun. The instant clip solves this problem by supporting a handgun only over a small area of its surface and in a position which does not cover the handgun's external operating mechanism, so that substantially the entire external surface of the handgun is exposed and available for gripping in a traditional shooting fashion. The handgun may remain in this position upon withdrawal from its support, whether that support is in or on the clothing of a user or on some secondary object.

To be available for rapid use, a handgun must be in the vicinity of a user's hands and readily accessible from normal hand positions. This requirement in practice has been manifest by handgun positioning at or about the waist, generally along the lateral portion or sometimes at anterior or posterior portions, or about the lateral portions of the upper torso, most commonly below the armpits. Traditional holsters usually have been designed for use at or about one or another of these positions, but a holster designed for use at one position may not be readily adaptable for use at another position and normally a holster has to have different types of supports for different positionings, even if the same holster were so usable. The instant support clip requires no particular positioning on a user or any support straps that are specially related to either waist or shoulder positioning of a handgun, but rather the same clip may be used to maintain the handgun at any body position, in distinguishment from the traditional shoulder and waist holsters of the present day.

Commonly when handguns are carried upon the person of a user or on a supporting structure in his presence, such as in a vehicle, about a desk or the like, it is desired for social and practical utilitarian reasons that the gun be concealed and not obvious to ordinary visual inspection. This often is difficult to accomplish with traditional holsters as a handgun itself has substantial bulk to allow visual indication of its whereabouts and a holster only accentuates this bulk and requires particular positioning and support which also accentuate the visual identification of a holstered gun. The instant clip resolves this problem by providing a holding device that is of insignificant bulk that adds nothing noticeable to the bulk of a supported handgun, while at the same time providing means that allow support of a handgun in or on the user's clothing at substantially any position desired. The instant clip commonly may be fastened upon the waist band of pants or a skirt, in the upper edge of pockets of coats or shirts, at the juncture of a sleeve with the body of a coat, in the front flap of a shirt or vest, or over a fold in the material of clothing or elsewhere about the body of a user. The clip allows the support of guns in non-traditional positions such as at the top of a boot, on a garter or stocking top, on various edges of underclothing and the like.

Resilient metallic clips have become known, though not commonly used, as a part of the structure of traditionally configured leather holsters to allow support of the holster and to more securely maintain guns in a holster. Such clips generally have been large and bulky, as opposed to the relatively small compact clip of the instant invention, and have not solved the general problems inherent in holsters as hereinbefore detailed. It is not known that elastically resilient metal clips configured and attached as the instant clip have heretofore been used directly with handguns.

The instant invention lies not in any one of these features individually, but rather in the synergistic combination of all of the structures of the invention that necessarily provide the functions flowing therefrom.

SUMMARY OF INVENTION

The instant handgun support provides an elongate, elastically resilient clip attached to the side of the body of a handgun to allow support on a person or object. The clip provides a rearward body portion, releasably fastenable to the handgun body, a medial portion extending forwardly toward the gun muzzle parallel to the barrel and at a spaced distance from the body, and a forwardmost fastening portion that is immediately adjacent the gun body. The clip body is fastened to a handgun body by bolts extending in threaded engagement between the two elements in cooperating holes defined in those elements. A species of clip for automatic pistols, of the type having a slide member carrying the barrel that moves relative to the body, may be positionally maintained by an "S" shaped bracket having one leg on each side of the gun body wall that defines the channel for the slide member. A support bracket for fastening a handgun with the instant clip on a support object provides two spaced fastening flanges with a medial element extending therebetween to receive and releasably maintain the clip. The clip is of relatively small size of approximately three and three-quarters inch length, with the body portion of approximately three-quarters inch width and the clip portion of approximately one-quarter inch in width.

In providing such a device, it is:

A principal object to provide a clip, to support a handgun on the clothing of a user or on some support structure, that is releasably attachable to the handgun, covers only a small portion of the surface of that handgun, and maintains the handgun in readily accessible fashion and habitually familiar position for use when supported by the clip.

A further object is to provide such a clip that may be fastened to the body or handle structure of most modern handguns, without change or modification in form of the handgun, by bolts extending in threaded engagement between the clip body and the handgun in cooperating holes defined in both structures.

A further object is to provide a species of such clip that may be releasably fastened to the body of an automatic handgun having a barrel slide moving relatively to a body, such as that manufactured by Baretta, Colt, Sig-Sauer, Browning or Smith and Wesson, by means of a "U" shaped clip bracket extending over the edge of the gun body that defines the channel for the barrel slide element of such a gun.

A still further object is to provide such a clip that does not interfere with the normal operation or handling of a handgun having the clip.

A still further object is to provide such a clip that is of new and novel design, of rugged and durable nature, of simple and economic manufacture and otherwise well adapted for the uses and purposes for which it is intended.

Other and further objects of the instant invention will appear from the following specification and accompanying drawings which form a part of this application. In carrying out the objects of the invention, however, it is to be remembered that its accidental features are susceptible of change in design and structural arrangement, with only preferred and practical embodiments of the best known modes being illustrated in the accompanying drawings and described in the specification, as is required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 6:
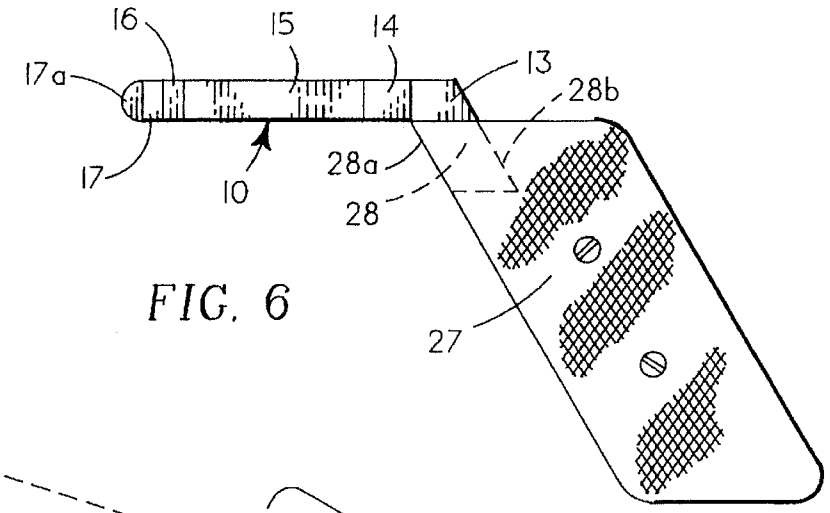
FIG. 6 is an isometric view of a third species of clip that is structurally carried by a handgun grip.

The instant invention generally provides clip 10 for support of handgun 11 on the clothing of a user (not shown) or on support bracket 12 structurally carried by some supportative object.

Clip 10 provides body 13 structurally interconnecting clip portion 15 by means of angulated inner transition element 14 extending therebetween. The outer end of clip portion 15 structurally communicates with outermost tang 17 by angulated outer transition element 16 extending therebetween. The inner and outer transition elements are so configured that body 13 and tang 17 are substantially coplanar, with the clip portion 15 extending parallel to the plane of the body and tang, but spacedly distant therefrom, as illustrated. The outer end portion 17*a* of the tang 17 preferably is rounded and angulated outwardly in the direction of the clip portion 15 to aid easy insertion over a support. This clip structure is preferably formed from a single elongate strip of relatively thin, narrow material that is elastically resilient, but yet provides sufficient strength and rigidity to maintain configuration and support a handgun to be serviced. The material of preference is spring steel, though other materials having appropriate physical characteristics, such as other metals, some polymeric materials and the like, will fulfill the requirements of the instant clip.

The inner surface of clip portion 15 that faces a plane through the body and tang preferably is covered with some frictional material 18 to aid positional maintenance of the clip and a supported gun on an object that is to support them. The frictional material of preference for this purpose is one element of a hook and loop type fabric fastener, and it appears that either the hook element or the loop element may be used for this purpose. Such material is not necessary, however, and other materials with frictional surface characteristics are within the ambit and scope of the instant invention, and the clip is operative without any secondary frictional element.

The dimensioning of the instant clip is not essential to its functioning, but for optimum utility the dimensioning should be somewhat of the proportions illustrated, with an overall length of approximately two and one-half inches to provide appropriate physical parameters for proper fastening and support of an ordinarily configured handgun.

The clip may be variously interconnected with a handgun. Three types of such interconnection that have been found practically useful are illustrated.

Figure 1:
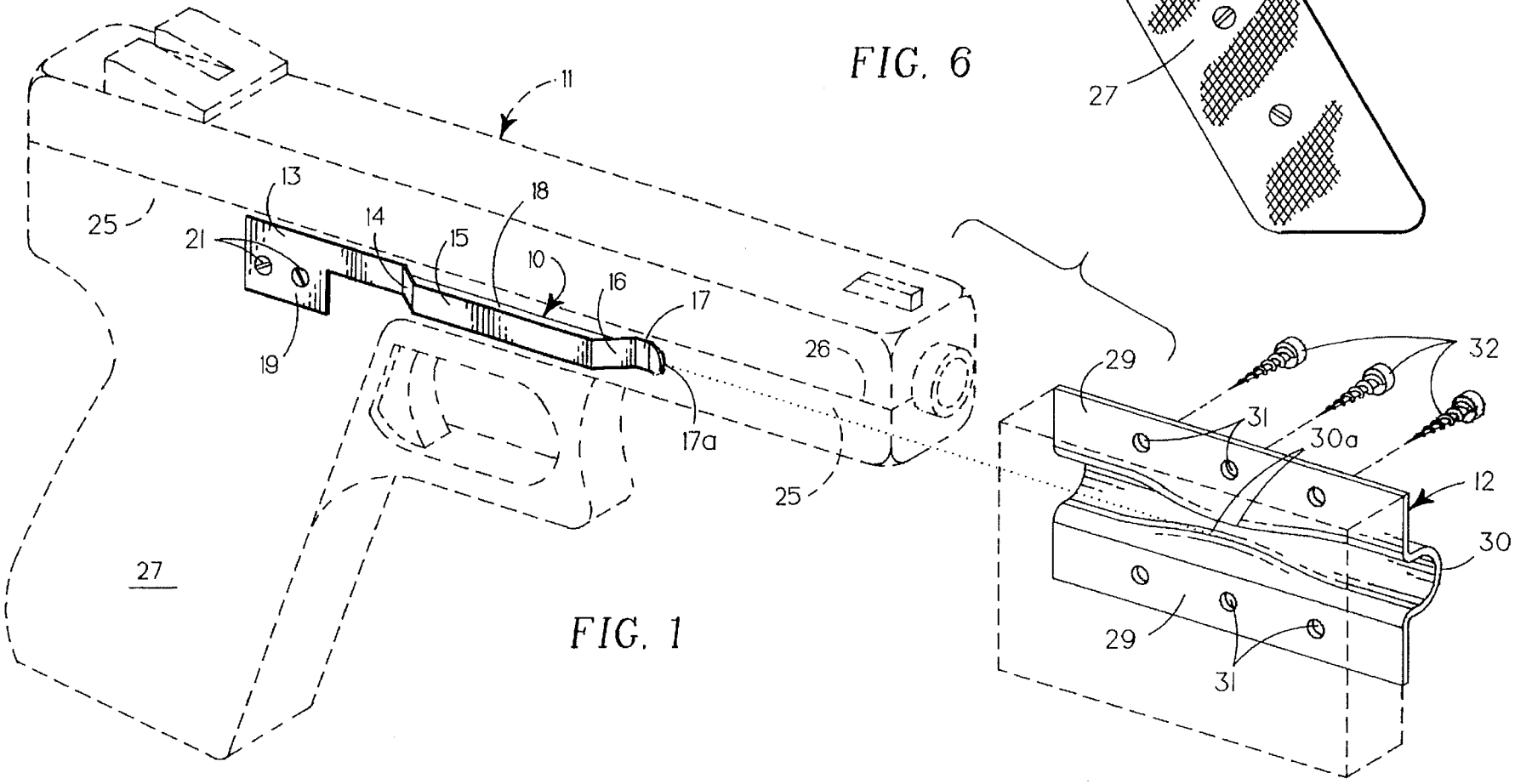
FIG. 1 is an isometric surface view of the first bolt fastened species of clip in place on a handgun, shown in dashed outline, with a clip support bracket shown on a support structure shown in dashed outline.
Figure 5:
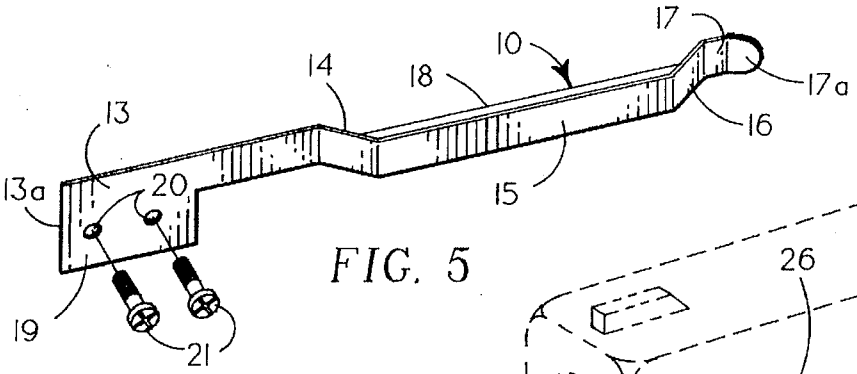
FIG. 5 is an isometric side view of the clip of FIG. 1 showing the fastening bolts and fabric type friction enhancing structure.

The species of fastener illustrated in FIGS. 1 and 5 provides fastening flange 19 extending a spaced distance from body 13 in a coplanar relationship with the body. The fastening flange defines plural spaced fastener holes 20, preferably but not necessarily two in number, to receive bolts 21 therethrough. Cooperating fastening holes (not shown) are defined in the body structure of a handgun and tapped to threadedly receive bolts 21 so that the first species of clip may be fastened to the handgun by such bolts. Normally the fastening will be accomplished essentially as shown in FIG. 1, with the upper portion of clip 10 being substantially at the juncture between the gun body and barrel slide for an automatic pistol, though the clip may be otherwise positioned on a handgun as desired, so long as the clip body 13 and tang 17 are substantially adjacent portions of the handgun so that the clip may serve its purpose to positionally maintain the gun on some supporting object.

Figure 2:
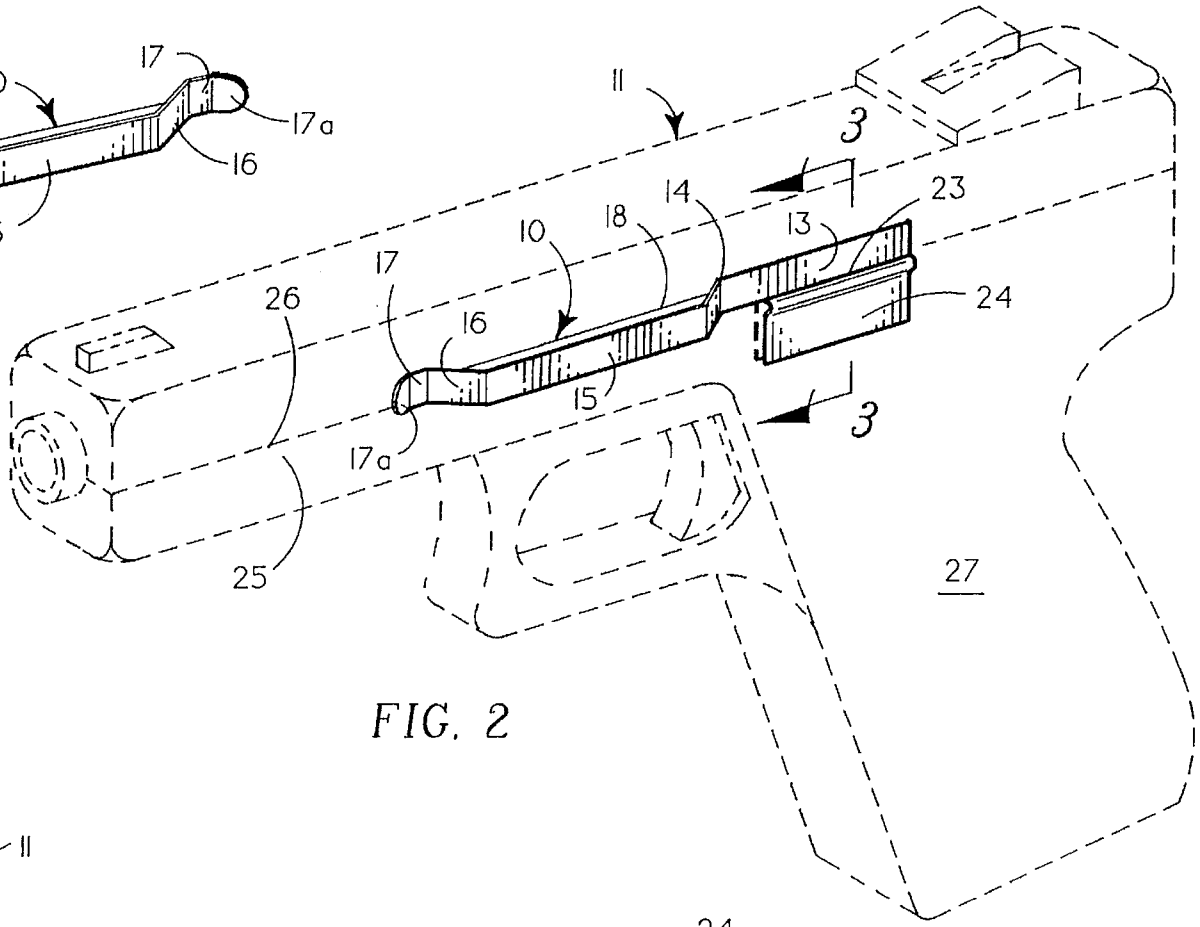
FIG. 2 is an isometric view of a second species of clip, fastenable by a bracket to some automatic handguns having separate barrel slide and body elements as shown in dashed outline, for use primarily by a right-handed shooter.
Figure 4:
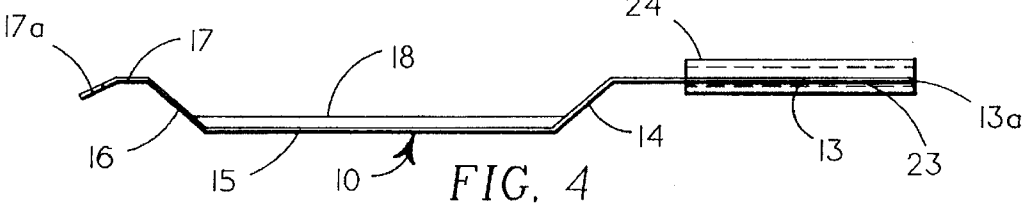
FIG. 4 is an orthographic top view of the clip of FIG. 2.
Figure 3:
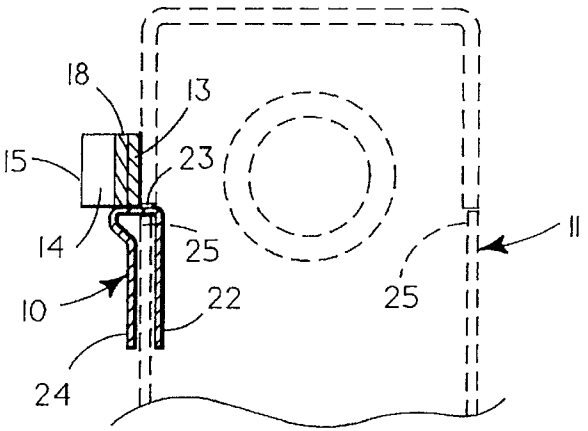
FIG. 3 is an enlarged, somewhat idealized, partial cross-sectional view of the clip of FIG. 2, taken on the line 2—2 thereon in the direction indicated by the arrows.

In the species of clip illustrated in FIGS. 2, 3 and 4, fastening is accomplished by a U-shaped clip bracket. This clip bracket is particularly adapted for use with certain automatic pistols having a body element extending forwardly beneath at least part of the barrel and carrying a barrel slide element that moves relative to the body element responsive to firing of the handgun to cause reloading of another shell into the chamber of the gun. Such guns are produced by various manufacturers, including in the modern day COLT, BARETTA, SIG-SAUER, BROWNING and SMITH AND WESSON. These guns provide a wall in the upper body portion 25, as shown somewhat diagrammatically in FIG. 3, that is a relatively thin upstanding structure over which the clip bracket of the second species may be supported.

The fastening clip of this second species of clip bracket is formed by inner leg 22 structurally interconnected by back 23 with outer leg 24 that is parallel to and spacedly distant from the inner leg, as illustrated particularly in FIG. 3. The distance between the inner and outer legs is substantially the same as the thickness of the wall of the upper body portion 25 of a gun which is to carry the clip bracket, and the thickness of back 23 is such that the back may extend through the space between the upper portion 25 of the gun body wall and the lower portion of a barrel slide 26 carried thereby. The clip bracket is structurally interconnected to the lower edge of clip body 13, with the clip body positioned on the back substantially above outer leg 24 of the clip bracket, so that when installed as illustrated in FIG. 2, the clip body will be immediately adjacent the barrel slide with tang portion 17 also adjacent the barrel slide.

The clip bracket is formed of relatively thin sheet material of appropriate strength and rigidity to serve the purposes required of the element. The material of preference is relatively thin sheet steel with some elastic resilience to aid positional maintenance of the element, though undoubtedly other materials having similar physical properties, such as other metals and harder, more dense polymeric materials, may fulfill the purposes of the instant invention. The dimensioning of the fastening clip of the second species is not critical so long as it fits as indicated upon a handgun to be serviced. This fit with most handguns will require some limitation in both clip length or horizontal dimension and clip depth or vertical dimension, at least of the inner leg.

The third species of clip, illustrated in FIG. 6, is structurally supported by one of the grips of a handgun. This type of support is particularly adapted for use with certain automatic pistols of the same type as that with which the second species of clip is used, though it may also be used with other types of handguns and even some revolvers. In this third species, the clip body 13 structurally carries a depending, somewhat angulated fastening flange 28. Clip body 13 is somewhat shortened so that it has substantially the same length as the horizontal extension of fastening flange 28. In the instance illustrated, the fastening flange 28 is angulated so that the forward edge **28*a* is parallel to the forward edge of gun grip 27 and the rearward edge of the clip is angulated so as to be parallel and coextensive with the rearward edge 28*b*** of the fastening flange.

The fastening flange 28 is carried in an appropriately sized and configured channel defined in the upper forward portion of one hand grip 27 and is mechanically fastened within that chamber. In the instance illustrated, the hand grip 27 is formed of polymeric material and the fastening flange 28 is positioned within that material at the time of molding to cause structural interconnection, though the flange well may be fastened by other mechanical means such as adhesion, bolting and the like. Preferably the angulation of the fastening flange 28 relative to grip 27 will be such that the clip 10 will be substantially parallel to the joint between a gun body and gun slide. This positioning, however, is largely for aesthetic purposes and the clip is effective if positioned in other orientations, so long as its fastening portions accomplish their intended purposes.

Having thusly described the structure of the instant invention, its use may be understood.

Firstly, a clip is formed according to the foregoing specification and installed upon a handgun as required by any of the three species of fastening. The first species of clip which fastens to a handgun by bolting requires the drilling and tapping of holes in the handgun body, and grip if necessary, to threadedly receive bolts 21. The second species is installed by disassembling the gun slide from the gun body, installing the clip bracket and then reassembling the gun slide and body in normal fashion. The third species of clip requires the formation of a particular hand grip to carry the clip and this may be accomplished either by creating a new hand grip or by machining an appropriate chamber in an existing hand grip and, in either case, fastening the flange 28 in the chamber by known methods as previously indicated.

In the use of the instant clip, it is to be noted that any of the species described may be positioned on either side of a hand gun, as desired. In general, it is more convenient for a right-hand shooter to have the clip on the left side of a gun so that the gun may be grasped more readily in a shooting position, and similarly for a left-handed shooter it normally is preferred that the clip be on the right side of a gun. Any of the species of clip allow either positioning.

After a gun is outfitted with the instant clip as aforesaid, it may be supported by the clip on clothing of a user or on some support object.

For support on clothing, a portion of the clothing that forms an edge, either by reason of its normal configuration or by folding upon itself, may be inserted between tang 17 and the adjacent portion of a gun and moved inwardly into the space defined between clip portion 15 and the adjacent gun. The clothing then will be maintained between the clip and gun, either by reason of the pressure thereon exerted by tang 17 against the gun body, by reason of friction exerted by element 18 on material between the clip portion and the gun, or both. Depending on the nature and thickness of material, it may also be possible to move the innermost portion of a material edge beneath the tang facing portion of clip body 13 to provide more secure holding, if necessary or desired.

During or after the support of a handgun by the instant clip, it may be positionally adjusted as desired to maintain it in proper orientation for quick and easy access and removal. A handgun serviced by the clip may be supported on a user's clothing at almost any position on a human body. The traditional and easiest positioning is at and about some edge of clothing such as the top of a boot or shoe, the top of a stocking, on a belt or the top of pants or a skirt, the top of a pocket defined in pants, skirts, shirts or coats or on the interconnection between the arm and body of a jacket, shirt or blouse at the arm pit. Less traditional positioning may be accomplished on folds of any portion of clothing such as in pants, shifts or coats, on the edges of underwear that may be readily accessed such as in the case of a female wearing a skirt or a loose blouse, on a garter or arm band, and in a hat band.

A support bracket may be used with the clip to support a gun on some object rather than on the person of a user. The support bracket seen in FIG. 1 provides similar, paired opposed elongate fastening flanges 29 interconnected by U-shaped channel element 30. Each fastening flange provides some means 31 for fastening on a support, in the instance illustrated comprising plural spaced holes through which screws 32 may be inserted to fasten the bracket upon support. Other fastening means such as adhesion, bolting or the like (not shown) are within the ambit of the fastening means. Preferably channel element 30 is formed of some semi-resilient material such as leather, rubber or plastic and if so, it is configured so that its medial portion 30*a* is somewhat narrower than either outer portion to provide better frictional engagement and fastening of a gun clip therein. The channel defined by channel element 30 at either of its end portions, however, should be incrementally larger than the width and thickness of the clip to allow easy insertion over the channel element. The length of the fastening bracket is not critical, but there is little purpose in the length being greater than the length of the clip portion forwardly of the body 13.

It may be desired to support a gun on some structure in the presence of a user but not upon his person, such as in the interior of an automobile, on a desk or cabinet, on a wall or column, or the like. For this purpose, the support bracket is appropriately established on the desired support structure and the clip inserted within the channel defined by that support bracket. The bracket does not allow too much adjustment of the positioning of the gun once supported, so normally the bracket itself will be appropriately positioned so that a gun supported in it will be in the orientation ultimately desired for it.

It is to be noted that with the instant clip a gun may be supported either on the clothing of a user or in a support bracket without any particular reference to gravity because the clip creates sufficient friction upon the support to cause appropriate positional maintenance. It is preferable, however, for most utility and practicality, to support a gun with the clip extending in or over a support in a somewhat vertical orientation so that gravity may aid the support, especially as against accidental displacement caused by non-voluntary movements of a user, actions of some third party, or unintended movement of clothing.

The foregoing description of the instant invention is necessarily of a detailed nature so that a specific embodiment of its best mode might be set forth as required, but it is to be understood that various modifications of detail, rearrangement and multiplication of parts might be resorted to without departing from its spirit, essence or scope.

Having thusly described the instant invention, what is desired to protect by Letters Patent, and

What is claimed is:

1. A support device for an automatic handgun having a body with an upper portion supporting a barrel slide movable relative to the body and a handle having removable grips, comprising:

an elastically resilient clip having a substantially planar elongate clip body extending along the handgun body and having fastening means for attachment to a handgun comprising a U-shaped clip bracket having a first inner leg structurally communicating by a back with a second outer leg, said first and second legs spaced to fit on both sides of the upper portion of the body of an automatic handgun having a barrel slide, with the back of the clip bracket extending between the gun body portion and barrel slide and the clip body being fastened substantially vertically above the second outer leg of the clip bracket, a clip portion structurally communicating with the clip body and extending forwardly, substantially parallel to the handgun body at a spaced distance therefrom, said clip portion having a high frictional material on its surface facing the handgun body and a tang portion structurally carried by the clip portion at its end opposite the clip body to extend forwardly in the plane of the clip body, said tang portion having an end distal from the clip body angulated outwardly away from the handgun body.

2. The support device of claim 1 carried by a handgun and supported by a support bracket having spacedly adjacent fastening flanges carried by a support structure, with a channel element extending therebetween to define a channel spacedly adjacent the support structure carrying the fastening flanges.

* * * * *